US010599171B2

(12) United States Patent
Wang et al.

(10) Patent No.: US 10,599,171 B2
(45) Date of Patent: Mar. 24, 2020

(54) LOAD-DEPENDENT CONTROL OF PARALLEL REGULATORS

(71) Applicant: Analog Devices Global Unlimited Company, Hamilton (BM)

(72) Inventors: Langyuan Wang, Shanghai (CN); Danzhu Lu, Shanghai (CN); Xiaohan Gong, Shanghai (CN); Bin Shao, Andover, MA (US)

(73) Assignee: Analog Devices Global Unlimited Company, Hamilton (BM)

( * ) Notice: Subject to any disclaimer, the term of this patent is extended or adjusted under 35 U.S.C. 154(b) by 0 days.

(21) Appl. No.: 16/050,742

(22) Filed: Jul. 31, 2018

(65) Prior Publication Data

US 2020/0042026 A1 Feb. 6, 2020

(51) Int. Cl.
*G05F 1/46* (2006.01)
*G05F 1/575* (2006.01)

(52) U.S. Cl.
CPC ..... *G05F 1/462* (2013.01); *G05F 1/575* (2013.01)

(58) Field of Classification Search
CPC ..... G05F 1/462; G05F 1/575
USPC ..... 323/304
See application file for complete search history.

(56) References Cited

U.S. PATENT DOCUMENTS 7,679,350 B2 3/2010 Falvey et al.
7,719,241 B2 5/2010 Dean
8,922,272 B1 12/2014 Kose et al.
9,195,247 B2 * 11/2015 Saito ..... G05F 1/468
9,785,222 B2 10/2017 Doyle et al.
2003/0178976 A1 * 9/2003 Xi ..... G05F 1/575 323/273
2009/0134858 A1 * 5/2009 Chen ..... G05F 1/56 323/282
2009/0278517 A1 * 11/2009 Kleveland ..... G05F 1/563 323/272

(Continued)

FOREIGN PATENT DOCUMENTS

CN 203027231 6/2013

OTHER PUBLICATIONS

Received STIC search report from EIC 2800 searcher John DiGeronimo dated Oct. 18, 2018. (Year: 2018).*

*Primary Examiner* — Nguyen Tran
*Assistant Examiner* — Htet Z Kyaw
(74) *Attorney, Agent, or Firm* — Schwegman Lundberg & Woessner, P.A.

(57) ABSTRACT

An electronic circuit includes parallel linear regulator circuits that support a range of different load currents. The electronic circuit includes a first linear regulator circuit coupled to an output node, a second linear regulator circuit coupled in parallel with the first linear regulator circuit and the output node, and a control circuit. The control circuit is configured to monitor the output node and to suppress or inhibit the second linear regulator circuit from supplying the output node when a representation of load power consumption is below a specified threshold. The first linear regulator circuit is configured to continue to supply a portion of the load power when the representation of load power consumption is above the specified threshold, and the control circuit may disable the second linear regulator circuit when the representation of load power consumption is below the specified threshold.

18 Claims, 7 Drawing Sheets

(56) References Cited

U.S. PATENT DOCUMENTS

| | | | | |
|---|---|---|---|---|
| 2013/0169246 | A1* | 7/2013 | Shao | G05F 1/56 323/266 |
| 2013/0293986 | A1* | 11/2013 | Lerner | G05F 1/573 361/18 |
| 2014/0062590 | A1* | 3/2014 | Khlat | H03G 3/3042 330/127 |
| 2015/0130292 | A1* | 5/2015 | Yeon | G05F 1/62 307/104 |
| 2016/0170424 | A1 | 6/2016 | Baek et al. | |
| 2017/0255214 | A1* | 9/2017 | Ho | G05F 1/56 |
| 2017/0279359 | A1* | 9/2017 | Goncalves | G05F 1/10 |

* cited by examiner

LOAD-DEPENDENT CONTROL OF PARALLEL REGULATORS

FIELD OF THE DISCLOSURE

This document pertains generally, but not by way of limitation, to voltage regulation circuits, and more particularly to linear regulator circuits such as low dropout (LDO) regulation circuits.

BACKGROUND

Voltage regulation circuits can accept input power from a variety of sources such as batteries, mains supplies, or other sources. Voltage regulation circuits generally provide a regulated output parameter, such as a regulated output voltage, having a specified output accuracy over a specified range of input, load, and environmental conditions. Such regulation circuits can be implemented using a variety of circuit topologies. For example, linear regulators generally control an output parameter using one or more of a series element (e.g., a pass transistor) or a shunt element (e.g., a shunt transistor). The series or shunt element can be controlled to modulate current flow or an output voltage across a range of values using a linear control scheme, generally where the series or shunt element is dissipative. Such dissipative losses can make linear regulators inefficient in comparison to other approaches.

Other regulator topologies, such as switched-mode regulators, can operate by toggling one or more series or shunt elements between fully-conducting and cut-off states. Generally, switched-mode voltage regulation circuits can perform voltage conversion to provide an output voltage that is below an input voltage magnitude (e.g., a buck topology), or an output voltage that is above the input voltage magnitude (e.g., a boost topology), or both (e.g., a buck/boost topology). Because the switching elements in a switched-mode regulator are not operated in an intermediate conductive state between cut-off or fully-conducting, dissipative losses in a switched-mode regulator may be lower than a linear regulator.

By contrast, low dropout (LDO) regulator circuits are a class of linear regulators that can be used to provide one or more of high output parameter accuracy across a range of conditions or tolerance of significant voltage excursions at the input. Such LDO regulators may be referred to as precision voltage regulators. LDO regulators may exceed the performance of switched-mode regulators in terms of output voltage accuracy or precision across a range of conditions.

SUMMARY OF THE DISCLOSURE

The subject matter described herein can provide linear voltage regulation having enhanced power efficiency using a scheme involving two or more parallel linear regulators having different biasing configurations and output current capabilities. As an example, a first linear regulator circuit can be configured to provide high efficiency, such as having a low quiescent current ($I_q$), when a load current remains within a specified range. If load current varies significantly, such as increasing by one or several orders of magnitude, a different second linear regulator circuit can be used, such as having a much larger $I_q$ value than the first regulator circuit. If the second circuit were used exclusively, the larger $I_q$ value diminishes efficiency at lighter loads or under a no-load condition.

The present inventors have recognized, among other things, that two (or more) regulator circuits can be provided, such as in a parallel configuration. Using a load-dependent control technique, at least one of the parallel circuits can be powered on or off, or placed in a reduced power consumption state depending on load condition. In this manner, a specified accuracy can be maintained over a range of load values (such as spanning several orders of magnitude in load current), while maintaining a lower $I_q$ value under light load conditions or no-load condition. The first and second linear regulator circuits can be low dropout (LDO) regulator circuits having different topologies.

In an example, load allocation between a first linear regulator circuit and a second linear regulator circuit can be performed such as by adding an offset voltage to a feedback node of at least one of the first or second regulators. In addition, or instead, a series current limiting element such as a resistor can be selectively coupled in series with an output of at least one of the first or second regulators to shift a burden to another regulator circuit when both regulator circuits are operational contemporaneously.

An example can include or use subject matter (such as an apparatus, a method, a means for performing acts, or a device readable medium including instructions that, when performed by the device, can cause the device to perform acts), such as can include or use an electronic circuit comprising parallel linear regulator circuits supporting a range of different load currents, the electronic circuit comprising a first linear regulator circuit coupled to an output node, a second linear regulator circuit coupled in parallel with the first linear regulator circuit and the output node, and a control circuit configured to monitor the output node, and configured to suppress or inhibit the second linear regulator circuit from supplying the output node when a representation of load power consumption is below a specified threshold. In an example, the first linear regulator circuit is configured to continue to supply a portion of the load power when the representation of load power consumption is above the specified threshold. In an example, the control circuit is configured to disable the second linear regulator circuit when the representation of load power consumption is below the specified threshold. In an example, the control circuit comprises a comparator circuit configured to monitor a voltage at the output node, the control circuit configured to trigger enhanced output from either the first or second linear regulator circuits when monitored voltage dips below a specified threshold. In an example, the control circuit is configured selectively add a current limiting element to an output of the first linear regulator circuit when the representation of load power consumption exceeds the specified threshold. In an example, the control circuit is configured to add a specified offset voltage to a feedback node of the first linear regulator circuit when the representation of load power consumption exceeds the specified threshold.

An example can include or use subject matter (such as an apparatus, a method, a means for performing acts, or a device readable medium including instructions that, when performed by the device, can cause the device to perform acts), such as can include or use a method for controlling parallel linear regulator circuits to support a range of different load currents, the method comprising monitoring a representation of a load power consumption, controlling a first linear regulator circuit to supply the load when the representation of load power consumption is below a specified threshold, and controlling a second linear regulator circuit to supply the load in combination with the first linear regulator circuit when representation of load power consumption is above the specified threshold.

This summary is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

As mentioned above, a linear regulator circuit, such as a low dropout (LDO) regulator circuit, can provide enhanced voltage regulation accuracy or precision as compared to other regulator topologies. A tradeoff can exist between such accuracy or precision, and a power conversion efficiency of the regulator circuit. The present inventor has recognized that using two (or more) linear regulator circuits together in a parallel configuration can provide enhanced current-handling capability, and such linear regulator circuits can be controlled in response to changing load conditions. For example, a first linear regulator circuit can have a bias current (e.g., quiescent current, $I_{q1}$) that is much lesser in magnitude than the second linear regulator circuit.

When load current demand is relatively low (such as below a specified threshold), the first linear regulator circuit can meet such demand, alone. If load current demand increases, the second linear regulator circuit can provide supplemental capability. In an example, the second linear regulator circuit can have a bias current (e.g., $I_{q2}$) that is significantly greater in magnitude than the first linear regulator circuit. In this scheme, the second linear regulator circuit can provide a specified output voltage regulation accuracy or precision at higher load current demand, but such a second linear regulator circuit can be disabled or biased differently to avoid unnecessary power dissipation when load current diminishes.

Figure 1:
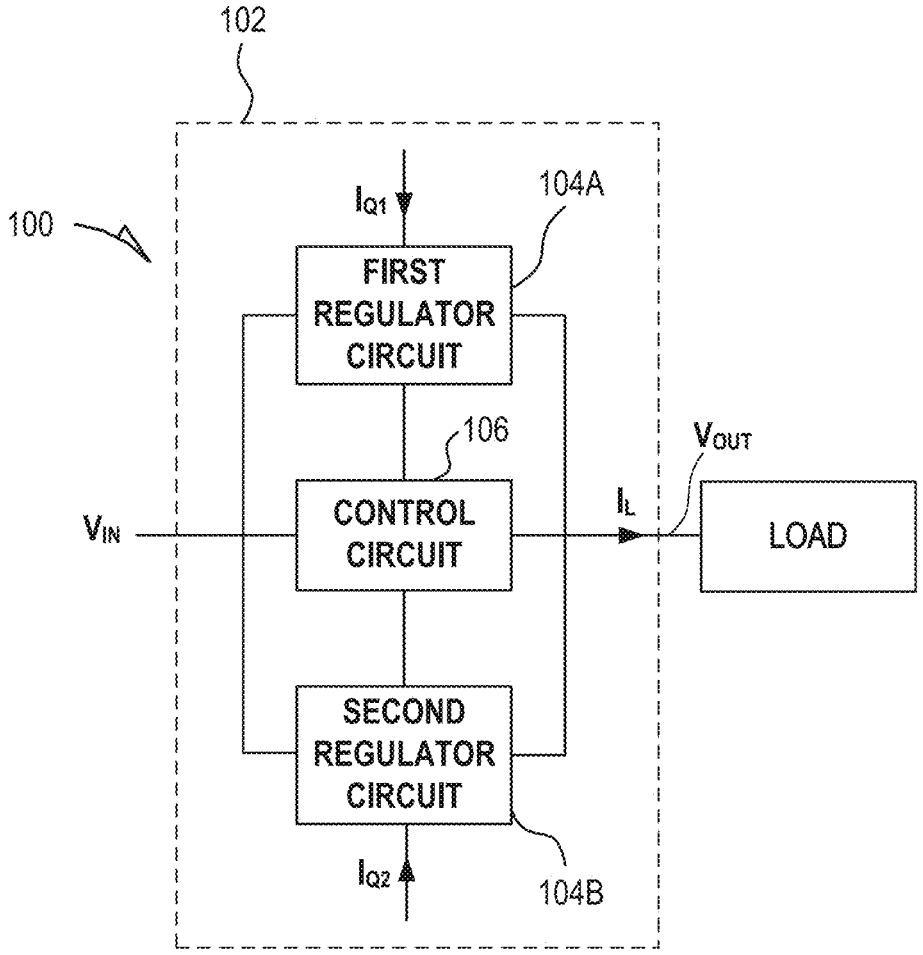
FIG. 1 illustrates generally an example comprising an electronic circuit that can include a first linear regulator circuit, a second linear regulator circuit, and a control circuit.

FIG. 1 illustrates generally an example comprising an electronic circuit 100 that can include a first linear regulator circuit 104A, a second linear regulator circuit 104B, and a control circuit 106. The first linear regulator circuit 104A, the second linear regulator circuit 104B, and the control circuit 106 can be co-integrated within a commonly-shared integrated circuit package 102. For example, portions or entireties of each of the first linear regulator circuit 104A, the second linear regulator circuit 104B, and the control circuit 106 can be co-integrated within a commonly-shared integrated circuit die. The present inventor has recognized that use of two or more linear regulator circuits can be connected in a parallel configuration, such as to provide a regulated output voltage a node $V_{OUT}$, when supplied by an input node, "$V_{IN}$." The $V_{IN}$ node can be an output of an unregulated supply, such as a stepped-down and rectified mains voltage, an output from a battery, or an output from another source or energy storage device. The control circuit 106 can be configured to enable, disable, or otherwise control the first and second linear regulator circuits 104A and 104B, such as in response to changing load or supply conditions. For example, a representation of load power consumption, such as a load current, "$I_L$," can be monitored by the control circuit 106. Under light load conditions, the first linear regulator circuit 104A can supply the load current $I_L$ to the node $V_{OUT}$, such as exclusively. If the load current $I_L$ exceeds a specified threshold, then the second linear regulator circuit 104B can be enabled, such as to supply the load current $I_L$ in combination with the first regulator circuit.

In one approach, the first linear regulator circuit 104A can be disabled when the second linear regulator circuit 104B is enabled. Such an approach can present a challenge because a certain recovery or startup time would generally be required if the first linear regulator circuit 104A were disable. The present inventor has recognized that by keeping the first linear regulator circuit 104A "alive" to supply at least a portion of the load current demand allows the first linear regulator circuit 104A to rapidly resume duty as the primary regulator circuit, such as when load current demand falls, such as when the second linear regulator circuit 104B is disabled.

Figure 6:
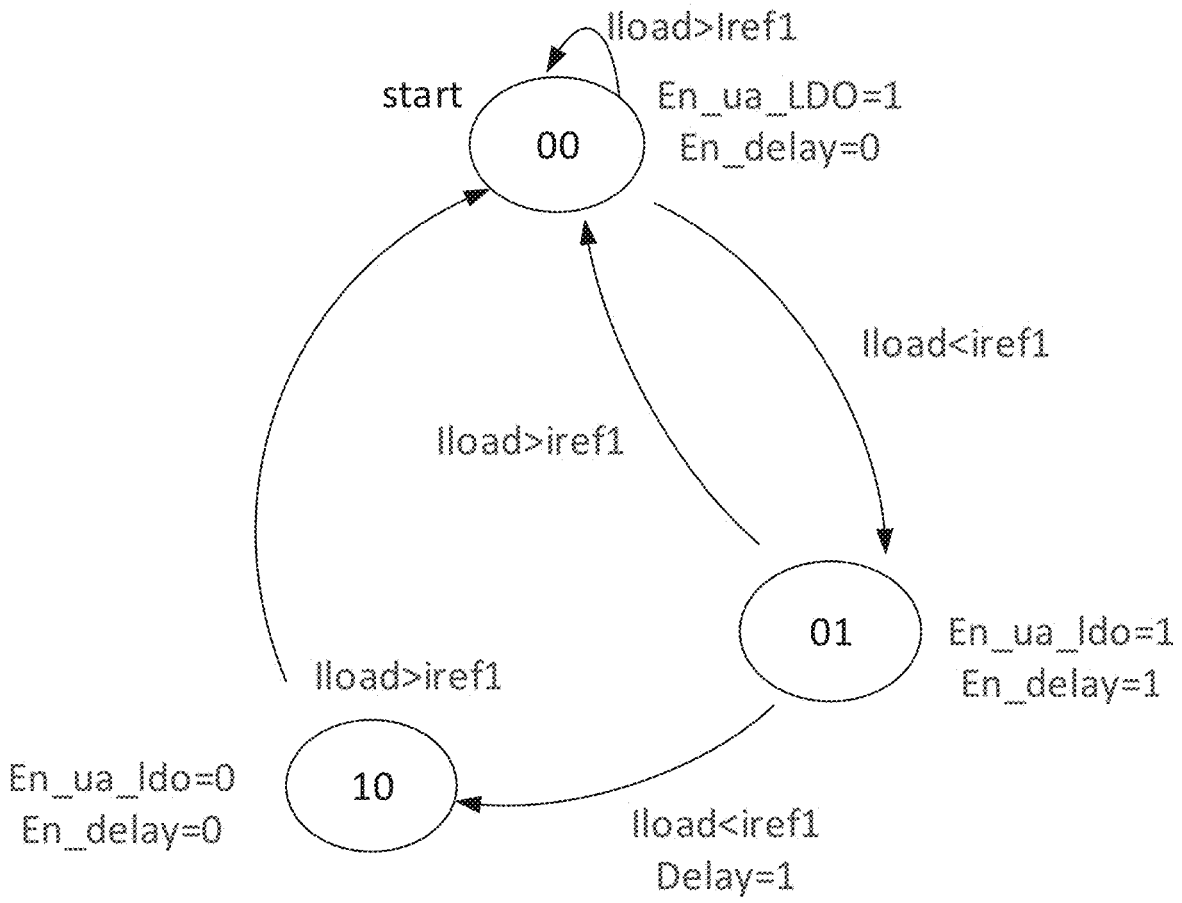
FIG. 6 illustrates generally an example comprising a technique, such as can be implemented using a control circuit, to provide different operating modes or "states" of an electronic circuit.

In an illustrative example, the control circuit 106 can implement a state machine supporting various modes or states, such as shown illustratively in the example of FIG. 6. Such a state machine can be implemented as a combination of register and combinational logic, or as a stored set of instructions executable by a processor circuit (e.g., a microcontroller or microprocessor coupled to a memory, as examples).

As an illustrative example, the first linear regulator circuit 104A can have a first bias current (e.g., such as corresponding to quiescent current $I_{Q1}$). Such a bias current can be in range of a few nanoamperes to a few tens of nanoamperes, as an illustrative example, corresponding to a low dropout (LDO) linear regulator circuit topology such as shown illustratively in FIG. 3. In such an illustrative example, if the load current $I_L$ exceeds a specified threshold of, for example, about 100 microamps, then the second linear regulator circuit 104B can be enabled by the control circuit 106. The second linear regulator circuit 104B can have a second bias current (e.g., such as corresponding to quiescent current $I_{Q2}$) that is much larger than the first bias current, such as in the range of few microamps or a few tens of microamps. In this control scheme, the second linear regulator circuit 104B can provide support for a wider range of load currents $I_L$, and improved load response at heavy load. The second linear regulator circuit 104B can be disabled, or otherwise suppressed or inhibited from supplying current to the load, when the load current $I_L$ falls below the specified threshold (or a lower threshold if hysteresis or multiple thresholds are used). In this manner, efficiency is enhanced because the second linear regulator circuit 104B need not be consuming bias current when the load current $I_L$ (and related load power consumption) is relatively light. The first linear regulator circuit 104A and the second linear regulator circuit 104B can have different circuit topologies, as shown and described in other examples herein.

Figure 2:
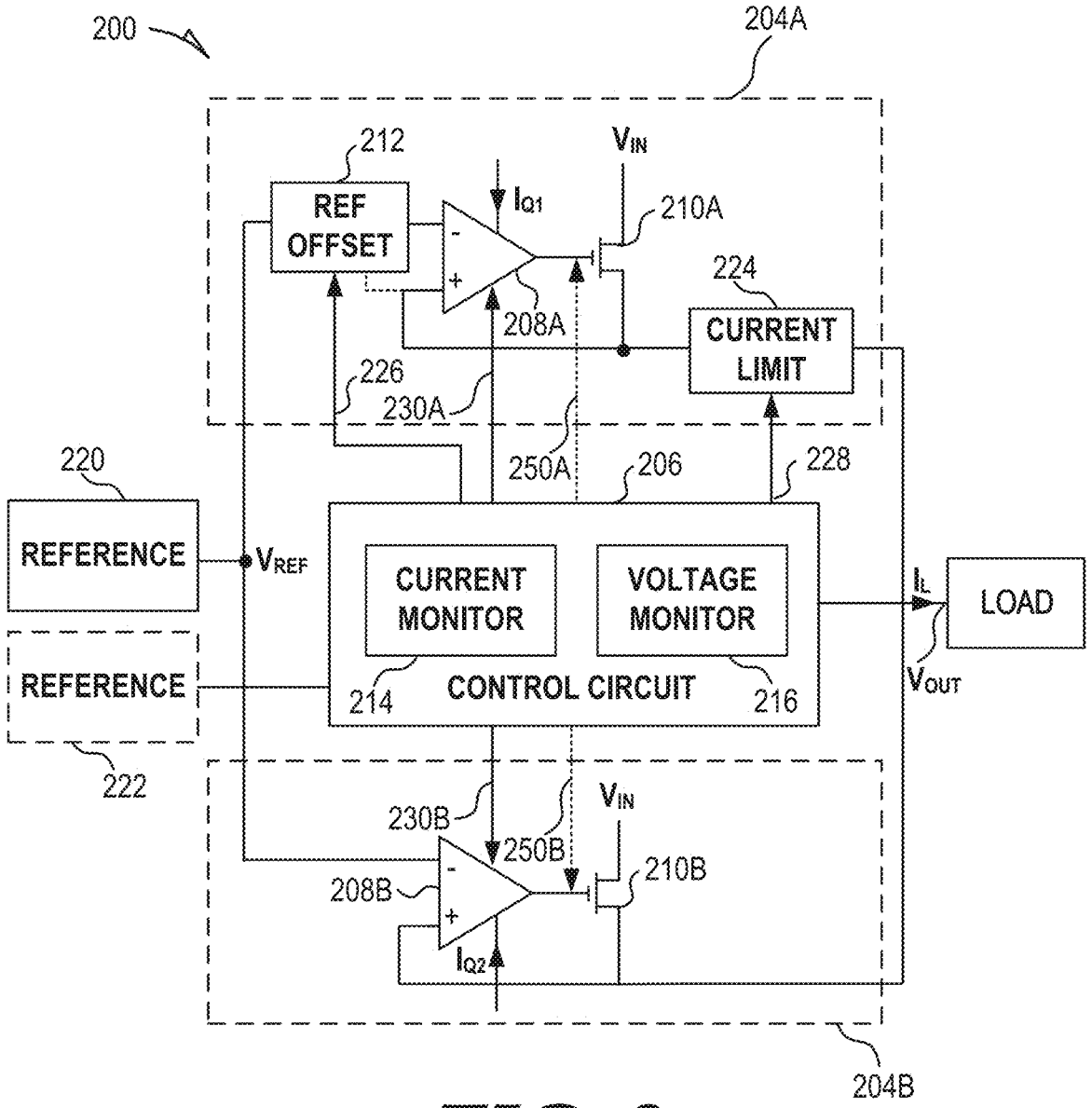
FIG. 2 illustrates generally an example comprising an electronic circuit that can include a first linear regulator circuit, a second linear regulator circuit, and a control circuit.

FIG. 2 illustrates generally an example comprising an electronic circuit 200 that can include a first linear regulator circuit 204A, a second linear regulator circuit 204B, and a control circuit 206. As in the example of FIG. 1, the electronic circuit 200 can be included within an integrated circuit or integrated circuit package assembly. The first linear regulator circuit 204A can include an error amplifier 208A coupled to an output transistor 210A, such as to receive an input voltage at a node $V_{IN}$, and to provide a regulated output voltage at a node $V_{OUT}$. The first linear regulator circuit 204A can have a bias current $I_{Q1}$ that is significantly lower in magnitude than a bias current $I_{Q2}$ of the second linear regulator circuit 204B. For example, the control circuit 206 can monitor a load current $I_L$, such as using a current monitor 214 (e.g., a comparator circuit configured to compare a signal indicative of the load current $I_L$ to one or more specified thresholds). When the load current (or other parameter indicative of load power consumption) is below a specified threshold, the control circuit 206 can control the first linear regulator circuit 204A to provide a majority or an entirety of the load current $I_L$. For example, the control circuit can include control lines 230A and 230B or other communicative couplings to the first and second linear regulator circuits 204A and 204B. When the load current $I_L$ exceeds the specified threshold, the second linear regulator circuit 204B can be enabled. The first linear regulator circuit 204A can remain enabled so that both the first and second linear regulator circuits 204A and 204B contribute to the load current $I_L$. The control circuit 206 can allocate respective portions of the load current to the first and second linear regulator circuit 204A and 204B.

For example, one or more of a current limiting element 224 or a reference offset 212 can be used, such as reduce or limit an output current from the first regulator circuit 204A when the second linear regulator circuit 204B is enabled. A control signal can be provided by a control line 226 to the reference offset 212, such as to enable the reference offset 212. Similarly, a control line 228 can be used, such as to control a state of the current limiting element 224 or to select a feedback node used by the first linear regulator circuit 204A, such as controlling states of the switches mentioned in relation FIG. 3 (e.g., SW1, SW2).

Referring to FIG. 2, as an illustrative example, the reference offset 212 can be coupled in series with a threshold voltage $V_{REF}$ provided by a voltage reference circuit 220 (e.g., a bandgap reference or other precision reference circuit), or across inputs to the error amplifier 208A of the first linear regulator circuit 204A. In addition, or instead, the current limiting element 224 (e.g., a resistor or transistor arranged as a series impedance) can be placed in-line with the output of the first linear regulator circuit 204A. A voltage drop across the current limiting element 224 can inhibit the first linear regulator circuit 204A from providing current exceeding a specified current limit, and the remaining portion of load current demand can then be satisfied by the second linear regulator circuit 204B. When the load current demand is light, such as monitored by the current monitor 214, the second linear regulator circuit 204B can be disabled.

A circuit topology of the first linear regulator circuit 204A can be different from the second linear regulator circuit 204B. For example, the first linear regulator circuit 204A can include a linear regulator topology as shown illustratively in FIG. 3, with an output transistor 210A including an n-type or a p-type field effect transistor (FET). The second linear regulator circuit 204B can include an error amplifier 208B, along with a multi-stage topology as shown illustratively in FIG. 4, with an output transistor 210B including an n-type or p-type field effect transistor (FET) rated for a higher current than the corresponding output transistor 210A of the first linear regulator circuit 204A.

The current monitor 214 can establish one or more current thresholds, such as derived from the reference circuit 220 or other reference circuits (e.g., a current reference circuit 222). For example, a first current threshold, $I_{REF1}$, can be established, and when the current monitor detects that a representation of $I_L$ exceeds $I_{REF1}$, then the second linear regulator circuit 204B can be enabled to provide a portion of $I_L$ in combination with the first linear regulator circuit 204A. A second current threshold, $I_{REF2}$, can be established, such as having a magnitude less than $I_{REF1}$. When the current monitor 214 detects that representation of $I_L$ falls below $I_{REF2}$ in magnitude, then the second linear regulator circuit 204B can be disabled or otherwise inhibited.

Figure 5:
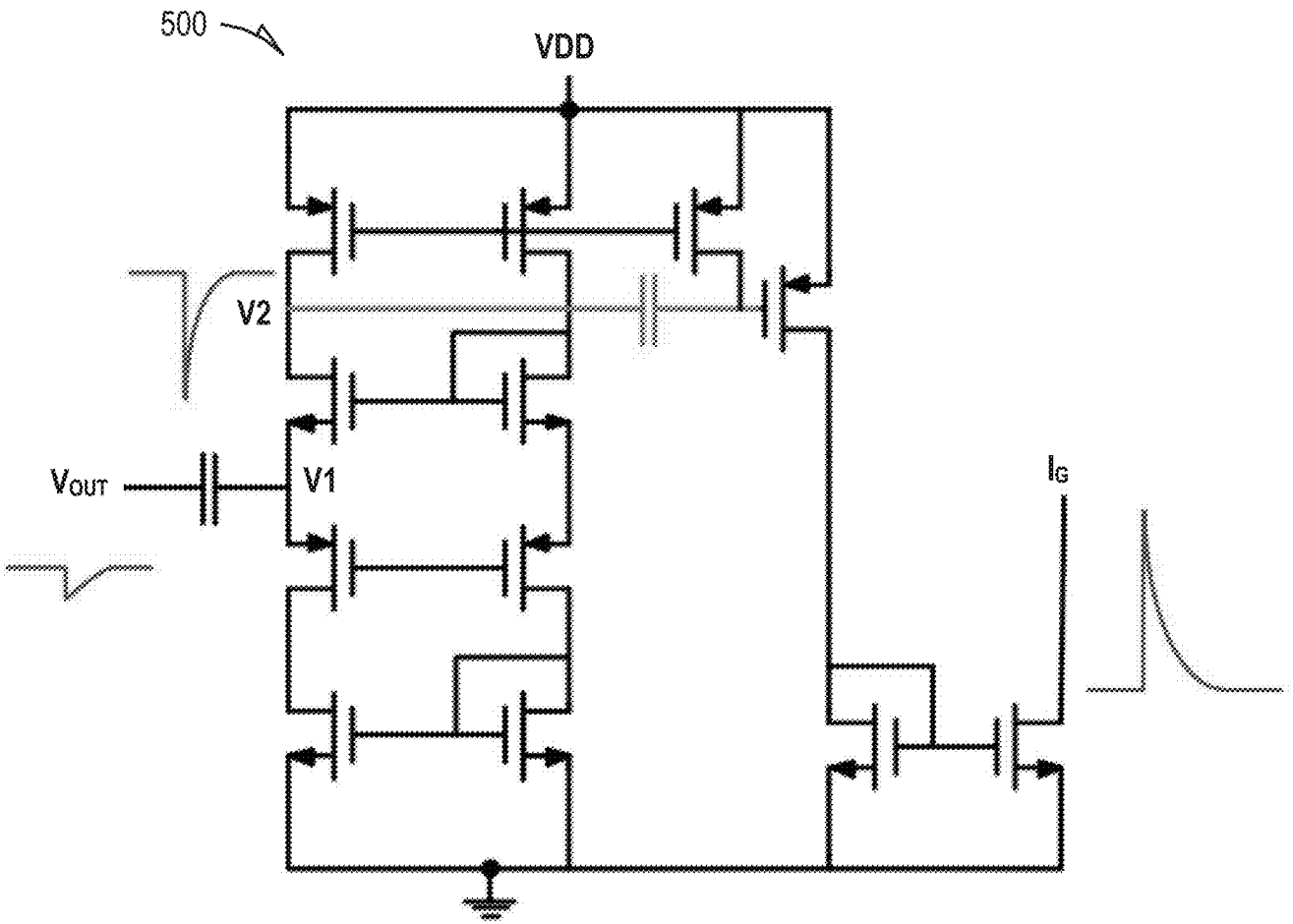
FIG. 5 illustrates generally an example comprising a voltage monitoring circuit, such as can be used to provide rapid response to a changing load condition such as by supplying a current to modulate an output of a linear regulator under transient conditions.

If a sudden change in load current demand occurs, the electronic circuit 200 can include a separate voltage monitor circuit 216, such as having a topology as illustrated in the example of FIG. 5. For example, the voltage monitor 216 can detect a transient dip in the output voltage of the circuit 200, $V_{OUT}$, and can generate one or more control signals coupled via gate control lines 250A or 250B (or other control lines) such as to modulate a current provided by one or more of output transistors 210A or 210B. In this manner, a separate control loop is provided to rapidly respond to transient load current changes by modulating an output of one or more of the first linear regulator circuit 204A or the second linear regulator circuit 204B.

Figure 3:
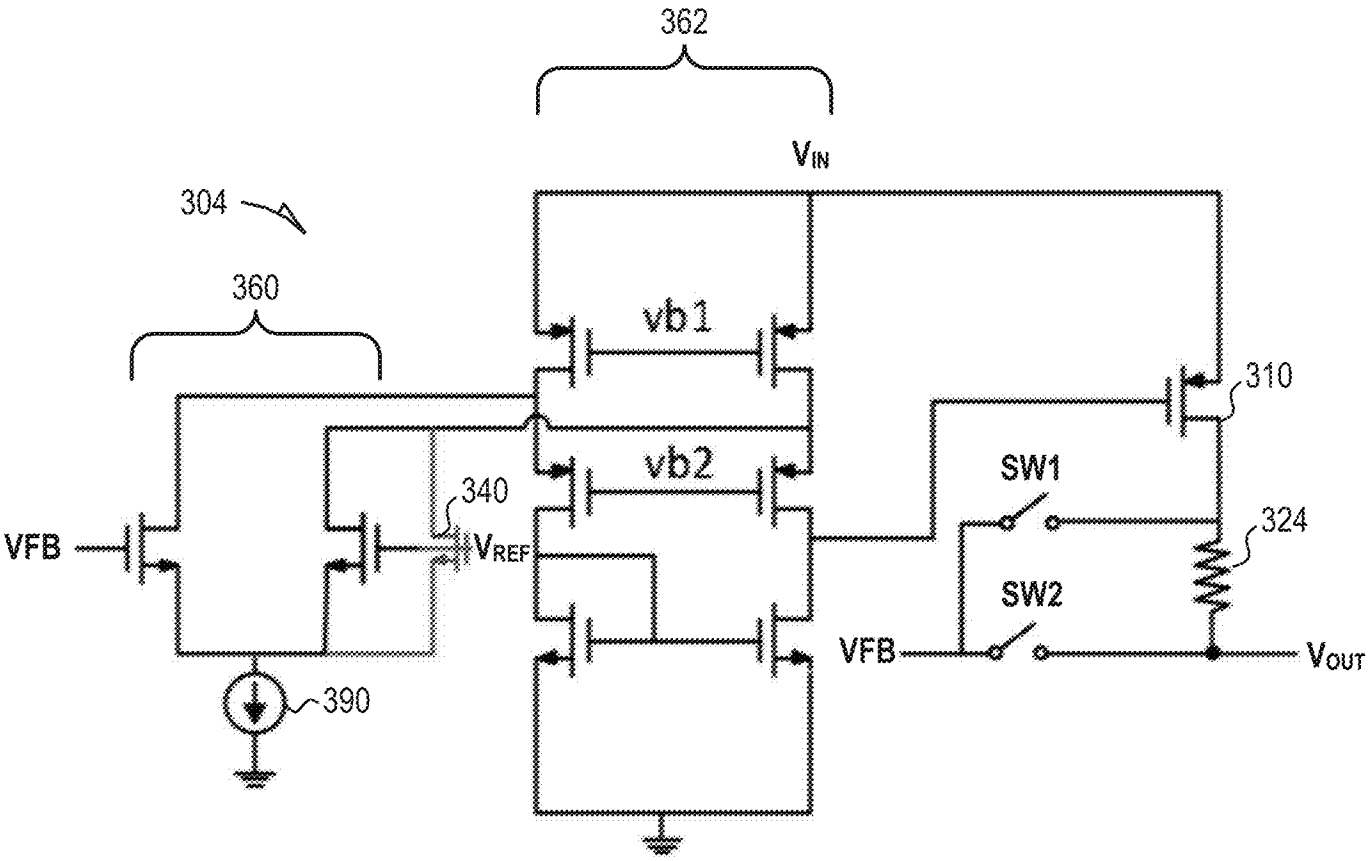
FIG. 3 illustrates generally an example comprising an electronic circuit having a linear regulator topology, such as can be referred to as a "low dropout" (LDO) regulator circuit.

FIG. 3 illustrates generally an example comprising an electronic circuit having a linear regulator topology, such as can be referred to as a "low dropout" (LDO) regulator circuit 304. The LDO regulator circuit 304 can include a differential input transistor pair 360 such as to provide an error signal indicative of a difference between a feedback node voltage (e.g., "$V_{FB}$") and a reference voltage, $V_{REF}$. The input transistor pair can include native devices to provide a specified input voltage range (such as spanning from about 0.6V to about 4.2V, in an illustrative example). Biasing such as provided by a current source 390, and voltages at nodes vb1 and vb2, can be established adaptively (e.g., in a load-dependent manner) to provide low quiescent current at light loads, and one or more of improved transient response or AC behavior at heavier loads. The error signal can be amplified by a gain stage 362, such as to control an output transistor 310 to receive an input voltage $V_{IN}$ and to supply a regulated output voltage to a node $V_{OUT}$.

As mentioned in relation to other examples herein, the LDO regulator circuit 304 of FIG. 3 can support various operating modes. For example, when a current supplied by the LDO regulator circuit 304 to the output node $V_{OUT}$ is below a specified threshold, the feedback node VF can be connected to the upper terminal of the current-limiting resistor 324 via closing switch SW1. When load current demand exceeds the specified threshold, the feedback node $V_{FB}$ can be connected to $V_{OUT}$ at the lower terminal of the current-limiting resistor 324 via opening switch SW1 and closing switch SW1. The feedback topology shown in FIG. 3 is a unity gain topology. A divider approach can also be used, such as to provide a scaled representation of $V_{OUT}$ as a feedback signal to the differential input transistor pair 360. In addition, or instead of using the current limiting element (resistor 324), and offset voltage can be imposed at an input 340 of the error amplifier. The offset voltage can be used to allocate a portion of the load to another regulator circuit connected in parallel with the LDO regulator circuit 304 of FIG. 3, as mentioned in relation to other examples described herein.

As an illustrative example, if load current exceeds about 500 microamperes, a second, higher-capacity regulator circuit can be enabled. The LDO regulator circuit 304 can be limited to a specified current output, such as about 1 mA. If a value of the current limiting resistor 324 is about 25 ohms, then at 1 mA load, about 25 mV is dropped across the current limiting resistor and the second, higher-capacity regulator circuit can supply a remainder of load current demand if in excess of 1 mA. For this example, the bias current for the LDO regulator circuit 304 can be about 15 nanoamperes (nA), according to simulation.

Figure 4:
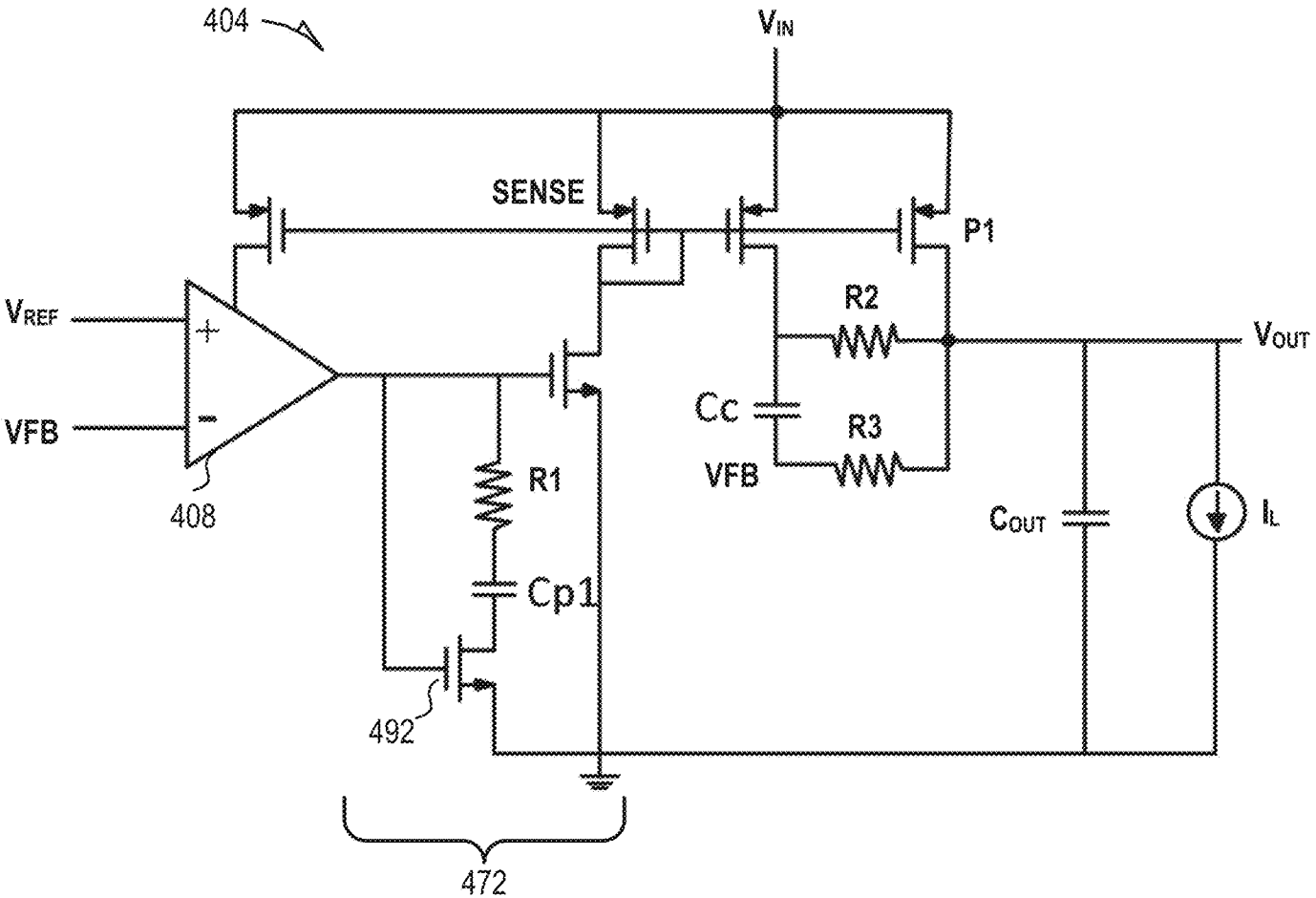
FIG. 4 illustrates generally another example comprising an electronic circuit having a linear regulator topology, such as can be referred to as a "low dropout" (LDO) regulator circuit.

FIG. 4 illustrates generally another example comprising an electronic circuit having a linear regulator topology, such as can be referred to as a "low dropout" (LDO) regulator circuit 404. By contrast with the LDO regulator circuit 304 of FIG. 3, the LDO regulator circuit 404 of FIG. 4 can include a larger output transistor P1. The LDO regulator circuit 404 can also include an arrangement that preserves a pole associated with the load capacitance ($C_{OUT}$) as a dominant pole. Such an arrangement can help to ensure stability across different load ranges or transient conditions. A feedback node, $V_{FB}$, provided through a compensated feedback circuit comprising resistors R2, R3, and capacitor $C_C$, can be coupled to an input of an error amplifier 408, and the other input can be coupled to a reference voltage $V_{REF}$. An error signal can be amplified by a gain stage 472, such as to control the output transistor P1 to receive an input voltage $V_{IN}$ and to supply a regulated output voltage to a node $V_{OUT}$. A transistor 492 (e.g., an NMOS FET device) can be coupled to R1 and CP1, such as to provide a pole and a zero in a loop transfer function of the LDO regulator circuit 404. For example, when the load current $I_L$ decreases, an output voltage provided by the error amplifier 408 can decrease in magnitude, and an impedance (e.g., on resistance) of the transistor 492 will increase, so the zero location in the transfer function will move to provide stabilization. Similarly, R2, R3, and Cc can generate a zero in combination with $C_{OUT}$ to provide closed-loop stability under a variety of conditions. A bias current supplied to the error amplifier 408 can be adaptive, such as established in part (e.g., proportionally to) an output current supplied by the output transistor P1. For example, if the load current $I_L$ is increasing, the bias current to the error amplifier 408 can increase such as to improve transient performance. As an illustrative example, a bias current for the LDO regulator circuit 404 can be microamperes or tens of microamperes, and the output current of the LDO regulator circuit 404 can be limited to about 100 mA.

FIG. 5 illustrates generally an example comprising a voltage monitoring circuit 500, such as can be used to provide rapid response to a changing load condition such as by supplying a current to modulate an output of a linear regulator under transient conditions. As mentioned in relation to FIG. 2, a voltage monitor can be used to detect a transient change in an output node of an electronic circuit (e.g., a node $V_{OUT}$ supplied by two (or more) linear regulator circuits coupled in parallel). In FIG. 5, a transient decrease in a magnitude of $V_{OUT}$ can be capacitively coupled to a node V1, and an amplified representation can be provided at a node V2. Such a representation can be used to provide a pulsed signal $I_G$ to one or both output transistors 210A or 210B of the first and second linear regulator circuits 204A and 204B shown in FIG. 2, as an illustrative example. In this manner, the circuit 500 of FIG. 5 can be used as a voltage monitor to detect a dip in output voltage magnitude and to trigger enhanced output from one or more linear voltage regulators, providing a secondary loop to charge an output of such linear voltage regulators, such as under transient high-load conditions.

FIG. 6 illustrates generally an example comprising a technique, such as can be implemented using a control circuit as mentioned in relation to other examples described herein, to provide different operating modes or "states" of an electronic circuit, such as a circuit including two or more parallel linear regulator circuits. In the illustrative example of FIG. 6, "na_LDO" can refer to a first linear regulator circuit, such as having a bias current in the nanoampere (or tens of nanoampere) range, "ua_LDO" can refer to a second linear regulator circuit, such as having a bias current in the microampere (or tens of microampere) range. In a state, 00, such as after startup, signal En_ua_LDO can be asserted to enable the second linear regulator circuit, and a counter can be disabled in response to a signal En_delay being de-asserted.

If a representation of a monitored load current, Iload, is greater than a threshold, Iref1, then the electronic circuit can remain in state 00. If the representation of the monitored load current Iload falls below Iref1 (or a second threshold, such as to implement a dead band or hysteresis), then the electronic circuit can transition to a state, 01. In state 01, En_ua_ldo can remain asserted (such as continuing to power the load by allocation portions of the load current between first and second linear regulator circuits), and a counter can be started by asserted En_delay. If the monitored representation of Iload increases and becomes greater than Iref1 before a delay expires, then the electronic circuit can transition back to state 00. If the delay expires (as indicated by assertion of a signal Delay), then the electronic circuit can transition to state, 10. In state 10, En_ua_LDO can be de-asserted, and En_delay can be de-asserted. In this manner, the second linear regulator circuit is inhibited or disabled for power savings, and the counter is stopped. In this state, the first linear regulator circuit can supply a majority or an entirety of the load current. If a monitored representation of the load current Iload is greater than Iref, then the electronic circuit can transition from state 10 to state 00, and the second linear regulator circuit can be enabled by asserted of En_ua_LDO.

Figure 7:
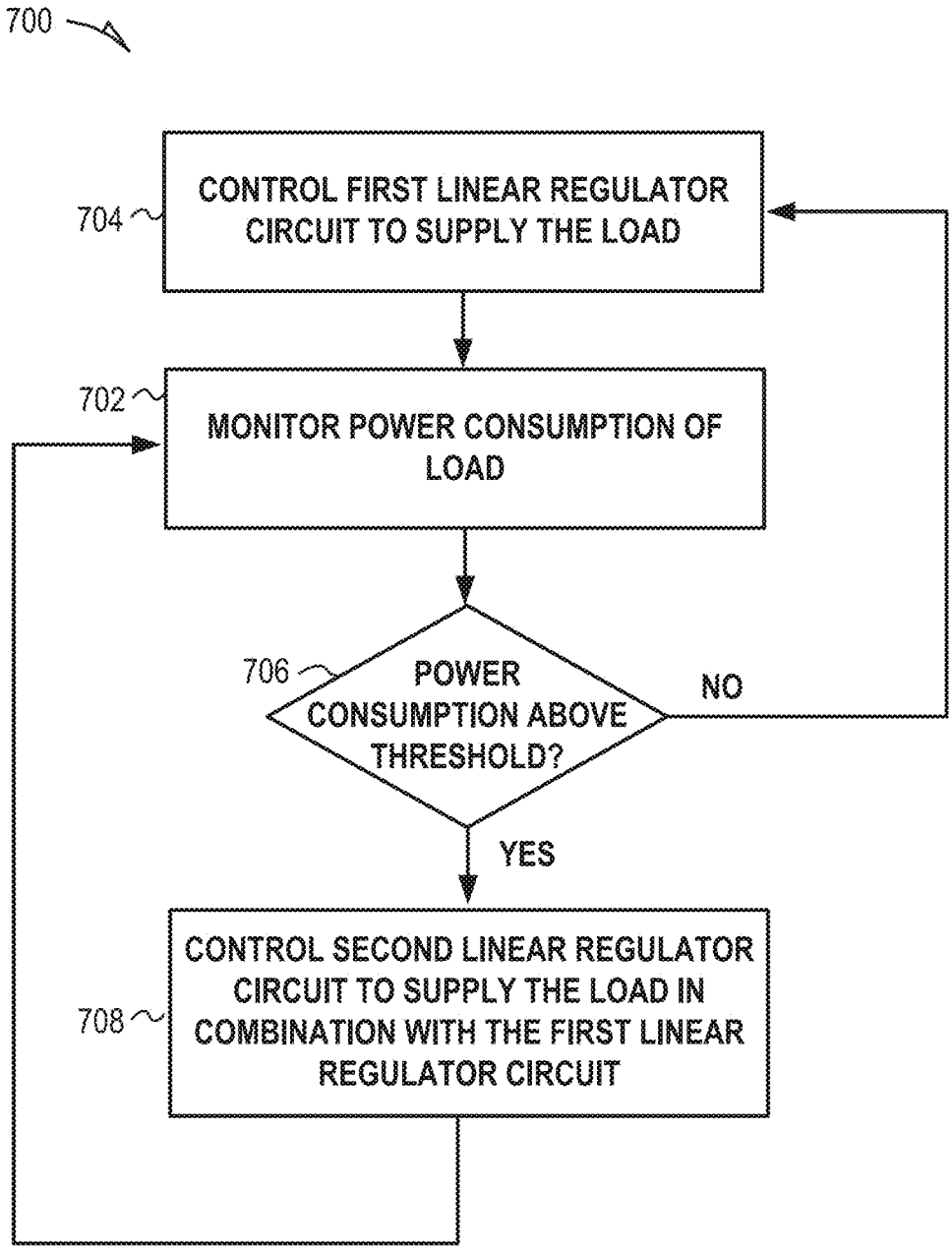
FIG. 7 illustrates generally a technique, such as a method, for controlling a first linear regulator circuit and a second linear regulator circuit.

FIG. 7 illustrates generally a technique 700, such as a method, for controlling a first linear regulator circuit and a second linear regulator circuit. At 702, a representation of power consumption of a load can be monitored, such as a load current. At 706, if the monitored representation of power consumption, such as load current, remains below a specified threshold, then at 704, a first linear regulator circuit can supply a majority or an entirety of the load current. At 706, if the monitored representation of power consumption, such as load current, is above the specified threshold, then at 708, a second linear regulator circuit can be controlled to supply the load in combination with the first linear regulator circuit. For example, the second linear regulator circuit can be configured to provide a higher output current than the first linear regulator circuit. At 706, if the monitored representation of power consumption falls below the specified threshold, then at 704 the second linear regulator circuit can be inhibited from supplying load current, such as disabled, and the first regulator circuit can supply a majority or an entirety of the load current. As mentioned above in relation to FIG. 6, if at 706 the power consumption is not above the specified threshold, a counter can be started or a delay can be established, such as to avoid disabling or inhibiting the second regulator circuit until the power consumption has been below the specified threshold for a specified duration. In this manner, a transient change in load current or other indicia of power consumption will not cause the second regulator circuit to toggle inefficiently between inhibited or operational modes.

The examples described in this document generally refer to use of first and second linear regulator circuits, but such examples are also applicable to schemes involving more than two parallel-connected linear regulator circuits. For example, various current ranges can be established, and corresponding regulator circuits can be controlled (e.g., enabled) to provide additional current handling capability as load current increases. The corresponding regulator circuits can be disabled or otherwise inhibited when load current decreases, in such a scheme. In this manner, power efficiency of a voltage regulation scheme can be maintained or enhanced across a wide range of load currents (e.g., spanning orders of magnitude).

VARIOUS NOTES

Each of the non-limiting aspects described in this document can stand on its own, or can be combined in various permutations or combinations with one or more of the other aspects or other subject matter described in this document.

The above detailed description includes references to the accompanying drawings, which form a part of the detailed description. The drawings show, by way of illustration, specific embodiments in which the invention can be practiced. These embodiments are also referred to generally as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of"at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. An electronic circuit comprising parallel linear regulator circuits supporting a range of different load currents, comprising:

a first linear regulator circuit coupled to an output node, the first linear regulator circuit having a first bias current;

a second linear regulator circuit coupled in parallel with the first linear regulator circuit and the output node, the second linear regulator circuit having a second bias current that is significantly greater in magnitude than the first bias current;

a control circuit configured to monitor power consumption at the output node, and when the power consumption is below a specified threshold, controlling the first linear regulator circuit to provide at least a majority of load current at the output node, and when the power consumption at the output node exceeds the specified threshold, enabling the second linear regulator circuit and allocating respective portions of the load current at the output node between the first and second linear regulator circuits.

2. The electronic circuit of claim 1, wherein the first linear regulator circuit is configured to continue to supply a portion of load power when a representation of load power consumption is above the specified threshold.

3. The electronic circuit of claim 1, wherein the control circuit is configured to disable the second linear regulator circuit when a representation of load power consumption is below the specified threshold.

4. The electronic circuit of claim 1, wherein the control circuit comprises a voltage monitor circuit configured to monitor a voltage at the output node, the control circuit configured to trigger enhanced output from either the first or second linear regulator circuits when the monitored voltage dips below the specified threshold.

5. The electronic circuit of claim 1, wherein the control circuit is configured to selectively add a current limiting element to an output of the first linear regulator circuit when the power consumption at the output node exceeds the specified threshold and the second linear regulator is enabled, wherein a remaining portion of load current demand at the output node is satisfied by the second linear regulator circuit.

6. The electronic circuit of claim 5, wherein the current limiting element comprises a series resistor between the output of the first linear regulator circuit and the output node, further comprising a switch coupled to the control circuit to selectively add or remove a resistance contribution from the series resistor.

7. The electronic circuit of claim 1, wherein the control circuit is configured to add a specified offset voltage to a feedback node of the first linear regulator circuit when the power consumption at the output node exceeds the specified threshold and the second linear regulator is enabled, wherein the offset voltage allocates a portion of load current demand at the output node to the second linear regulator circuit.

8. The electronic circuit of claim 1, wherein a quiescent current of the first linear regulator circuit is at least three orders of magnitude less than a quiescent current of the second linear regulator circuit.

9. The electronic circuit of claim 1, further comprising a load current monitoring circuit coupled to the control circuit, wherein the control circuit is configured to suppress or inhibit the second linear regulator circuit from supplying the output node when a load current as indicated by the load current monitoring circuit is below a specified load current threshold.

10. The electronic circuit of claim 9, wherein the specified load current threshold corresponds to a load current of about 100 microamperes.

11. The electronic circuit of claim 1, wherein the first linear regulator circuit and the second linear regulator circuit are low dropout (LDO) regulator circuits.

12. The electronic circuit of claim 1, wherein the first linear regulator circuit, the second linear regulator circuit, and the control circuit are co-integrated in an integrated circuit device package.

13. A method for controlling parallel linear regulator circuits to support a range of different load currents, the method comprising:

monitoring a representation of a load power consumption;

controlling a first linear regulator circuit having a first bias current to supply at least a majority of load current when the representation of the load power consumption is below a specified threshold; and enabling a second linear regulator circuit that is in parallel with the first linear regulator circuit and the load, the second linear regulator circuit having a second bias current that is significantly greater in magnitude than the first bias current, and allocating respective portions of load current between the first linear regulator circuit and the second linear regulator circuit when the representation of the load power consumption is above the specified threshold.

14. The method of claim 13, comprising disabling the second linear regulator circuit when the representation of the load power consumption is below the specified threshold.

15. The method of claim 13, comprising:

monitoring a voltage at an output node; and triggering enhanced output from either the first or second linear regulator circuits when the monitored voltage dips below a specified threshold.

16. The method of claim 13, wherein allocating the load between the first linear regulator circuit and a second linear regulator circuit includes monitoring a load current and an output voltage coupled to the load and allocating a portion of the load power consumption to the second linear regulator circuit in response to either of (1) the monitored current exceeding a specified current threshold or (2) the monitored output voltage dipping below a specified output voltage threshold.

17. An electronic circuit comprising parallel circuits supporting a range of different load currents, the electronic circuit comprising:

a first circuit comprising first linear regulator means for regulating an input voltage to provide a specified output voltage at an output node, the first linear regulator means having a first bias current;

a second circuit comprising second linear regulator means coupled in parallel with the first circuit for regulating the input voltage to provide the specified output voltage at the output node, the second linear regulator means having a second bias current that is significantly greater in magnitude than the first bias current; and control means for monitoring power consumption at the output node, and when the power consumption is below a specified threshold, for controlling the first linear regulator means to provide at least a majority of load current at the output node, and when the power consumption at the output node exceeds the specified threshold, enabling the second linear regulator means and allocating respective portions of the load current at the output node between the first and second linear regulator means.

18. The electronic circuit of claim 17, wherein the control means is configured to monitor a load current and an output voltage coupled to the load and to allocate a portion of the load power consumption to the second circuit in response to either of (1) the monitored current exceeding a specified current threshold or (2) the monitored output voltage dipping below a specified output voltage threshold.

* * * * *